US011633975B2

(12) United States Patent
Gerhart

(10) Patent No.: US 11,633,975 B2
(45) Date of Patent: Apr. 25, 2023

(54) BASE EXTENSION ASSEMBLY

(71) Applicant: Rick Gerhart, Sturgeon Bay, WI (US)

(72) Inventor: Rick Gerhart, Sturgeon Bay, WI (US)

( * ) Notice: Subject to any disclaimer, the term of this patent is extended or adjusted under 35 U.S.C. 154(b) by 168 days.

(21) Appl. No.: 17/189,883

(22) Filed: Mar. 2, 2021

(65) Prior Publication Data

US 2022/0281263 A1 Sep. 8, 2022

(51) Int. Cl.
*B43L 7/14* (2006.01)

(52) U.S. Cl.
CPC ..... *B43L 7/14* (2013.01)

(58) Field of Classification Search
USPC ..... 33/403, 464, 474, 479, 480
See application file for complete search history.

(56) References Cited

U.S. PATENT DOCUMENTS 426,001 A 4/1890 Evans
2,068,128 A 1/1937 Galford
2,246,066 A * 6/1941 Rothe ..... G01B 3/18 33/810
3,488,868 A * 1/1970 Gutowski ..... G01B 3/56 33/464
5,341,976 A 8/1994 Rider
5,813,126 A 9/1998 Dahl
5,992,034 A * 11/1999 Prucha ..... G01B 3/566 33/484
D512,332 S 12/2005 Graham
7,337,550 B2 * 3/2008 Marcus ..... B43L 7/14 33/DIG. 1
7,343,688 B2 * 3/2008 Price ..... B43L 7/02 33/418
8,375,592 B1 * 2/2013 Holt ..... B43L 7/12 33/456
8,522,447 B1 * 9/2013 Novotny ..... G01C 15/105 33/645
8,621,760 B2 1/2014 Norelli
8,763,265 B2 * 7/2014 Herniman ..... B43L 7/02 33/480
10,436,586 B1 * 10/2019 Davis ..... B43L 7/005
2006/0283033 A1 12/2006 Peterson
2010/0050451 A1 * 3/2010 Whitcomb ..... B43L 7/10 33/464
2017/0284784 A1 * 10/2017 Fuda ..... B23K 31/02

* cited by examiner

*Primary Examiner* — Christopher W Fulton

(57) ABSTRACT

A base extension assembly for measuring angles on a radiused corner includes a base that has a blade slot extending therein to insertably receive a blade of a combination square. The base has a channel is integrated therein to receive an anvil of the combination square. The base has a width that is greater than the width of the anvil such that the base extends beyond a radius of a corner is measured with the combination square thereby enhancing accuracy of the combination square. A pair of plates is each of the plates is positionable on the base to retain the anvil of the combination square in the channel.

7 Claims, 6 Drawing Sheets

BASE EXTENSION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to extension devices and more particularly pertains to a new extension device for measuring angles on a radiused corner. The device includes a base that is attachable to an anvil of a combination square to increase the width of the combination square. The device also includes a pair of plates that are attachable to the base, and which partially extend across the anvil, for attaching the base to the anvil.

(2) Description of Related Art Including Information Disclosed Under 37 CFR 1.97 and 1.98

The prior art relates to extension devices including a variety of combination squares for measuring various angles involved with construction. The prior art discloses a variety of extension devices that can insertably receive a framing square for retaining the framing square at a selected location on a member. In no instance does the prior art disclose a base that can slidably receive an anvil of a combination square and insertably receive a blade of the combination square.

BRIEF SUMMARY OF THE INVENTION

An embodiment of the disclosure meets the needs presented above by generally comprising a base that has a blade slot extending therein to insertably receive a blade of a combination square. The base has a channel integrated therein to receive an anvil of the combination square. The base has a width that is greater than the width of the anvil such that the base extends beyond a radius of a corner is measured with the combination square thereby enhancing accuracy of the combination square. A pair of plates is each of the plates is positionable on the base to retain the anvil of the combination square in the channel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
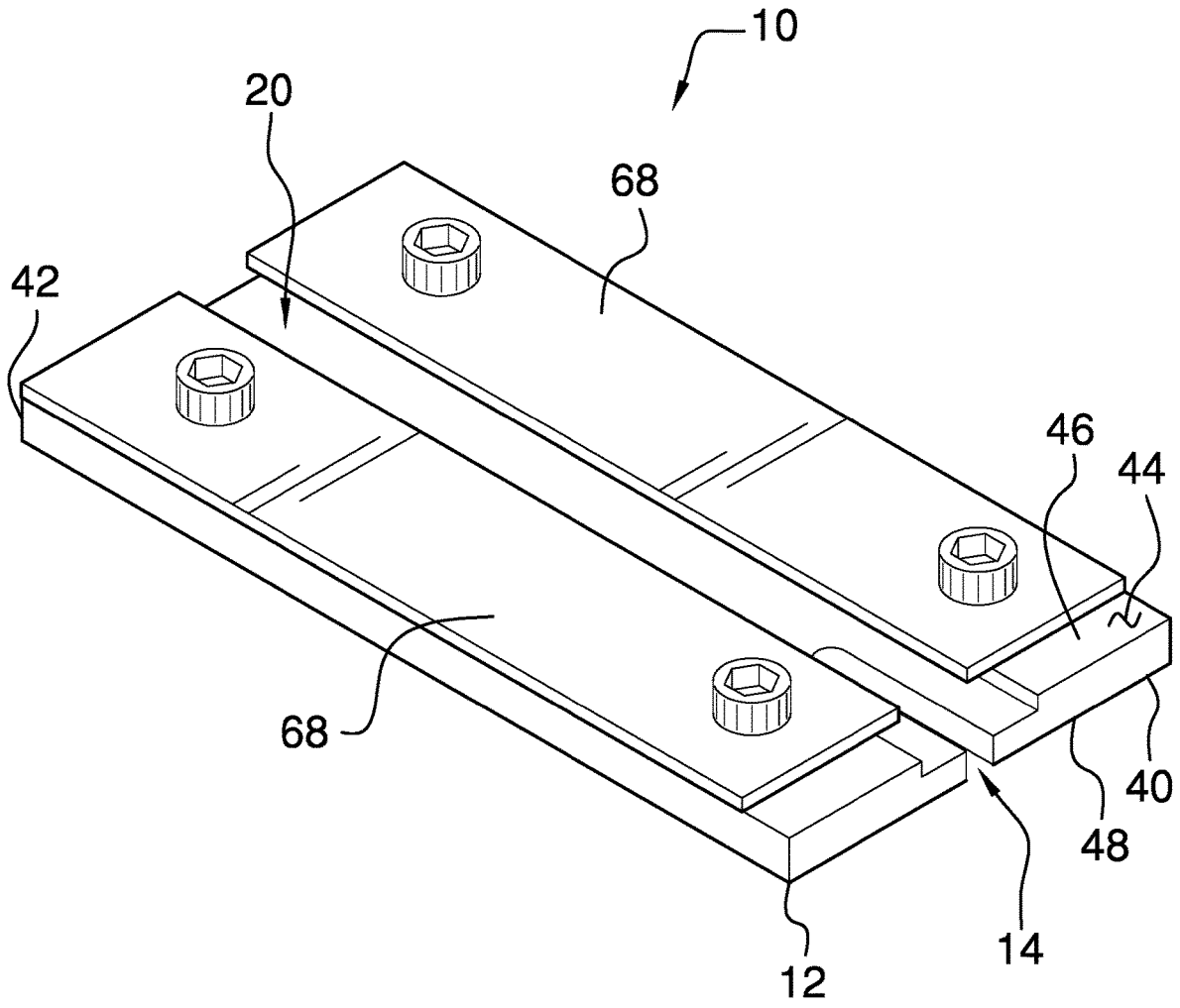
FIG. 1 is a top perspective view of a base extension assembly according to an embodiment of the disclosure.
Figure 2:
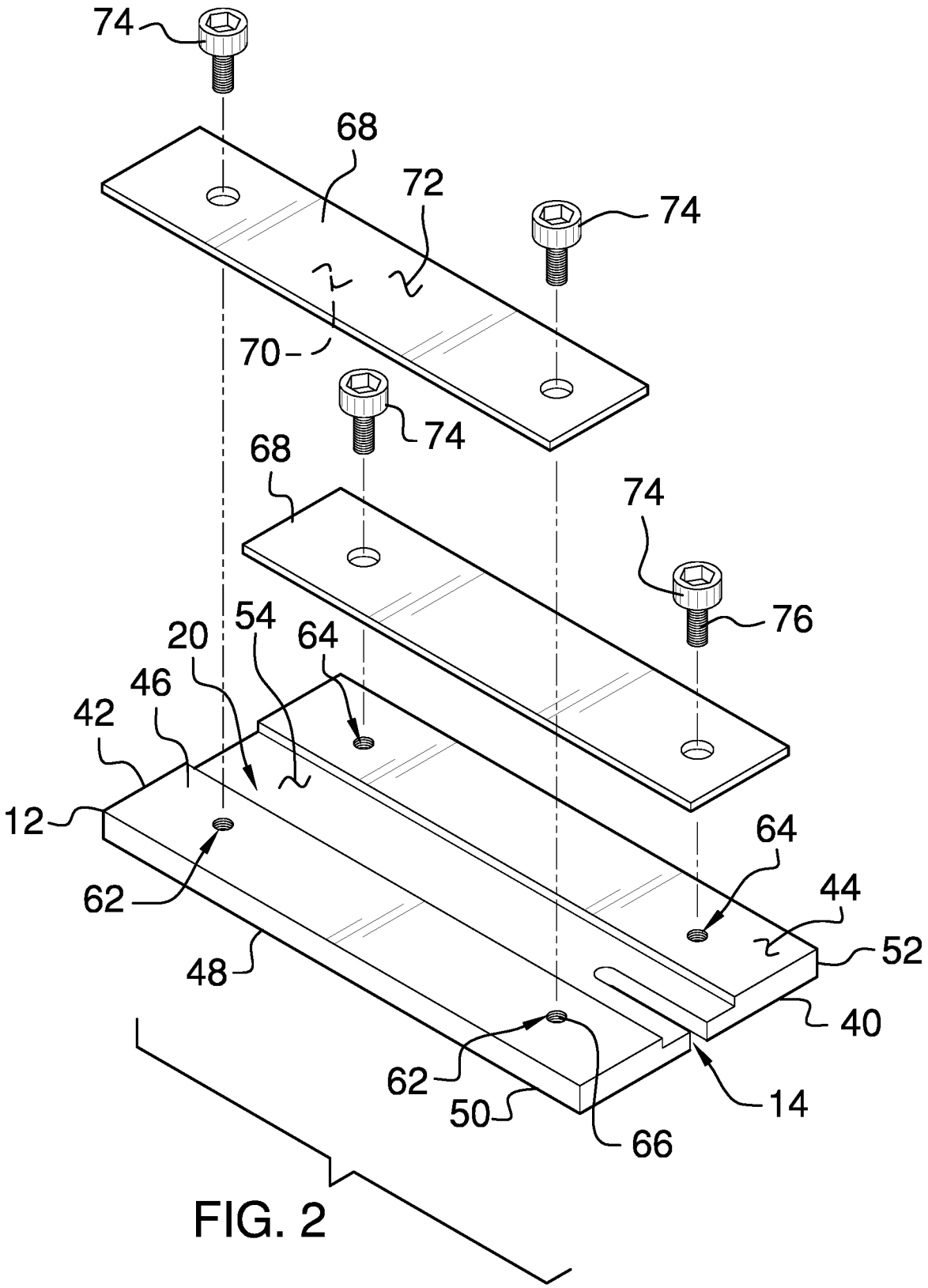
FIG. 2 is an exploded perspective view of an embodiment of the disclosure.
Figure 3:
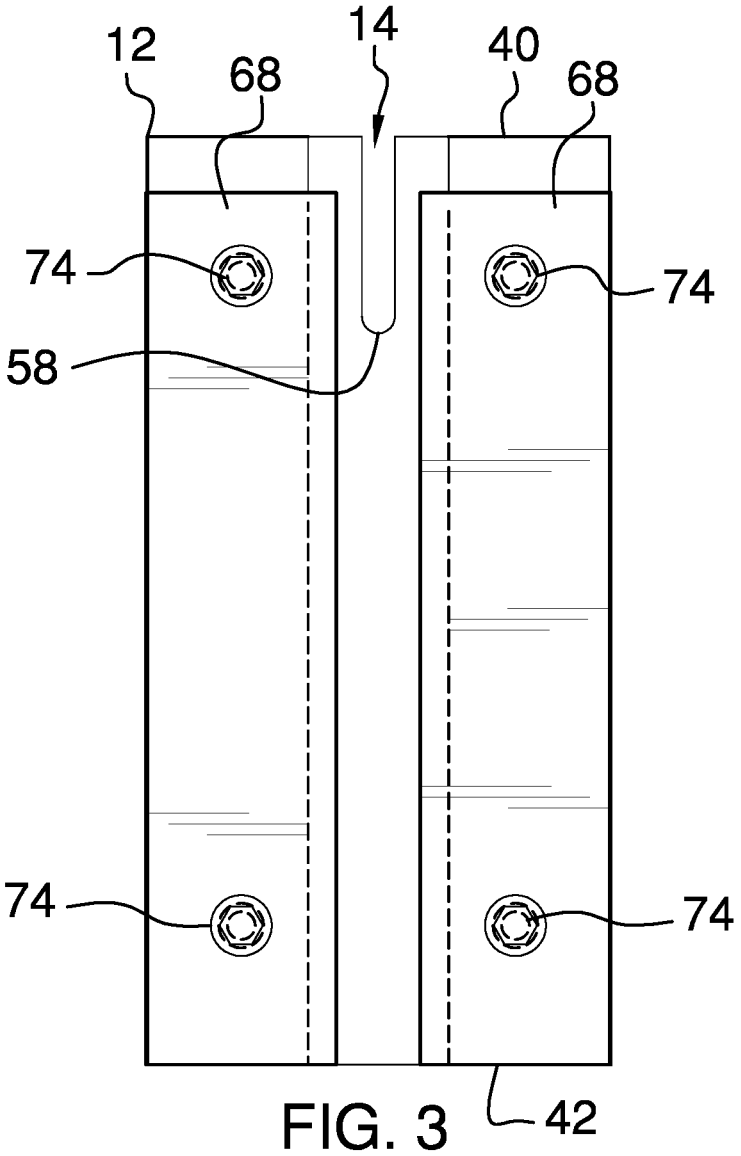
FIG. 3 is a top phantom view of an embodiment of the disclosure.
Figure 4:
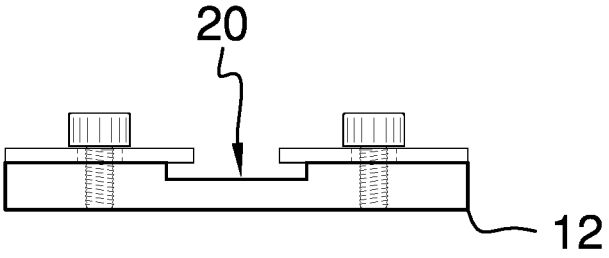
FIG. 4 is a back view of an embodiment of the disclosure.
Figure 5:
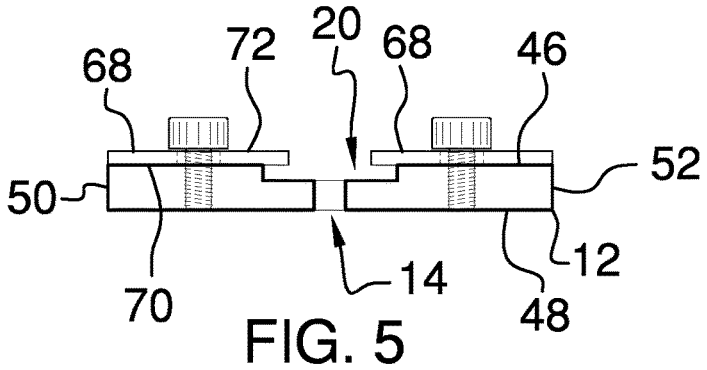
FIG. 5 is a front view of an embodiment of the disclosure.
Figure 6:
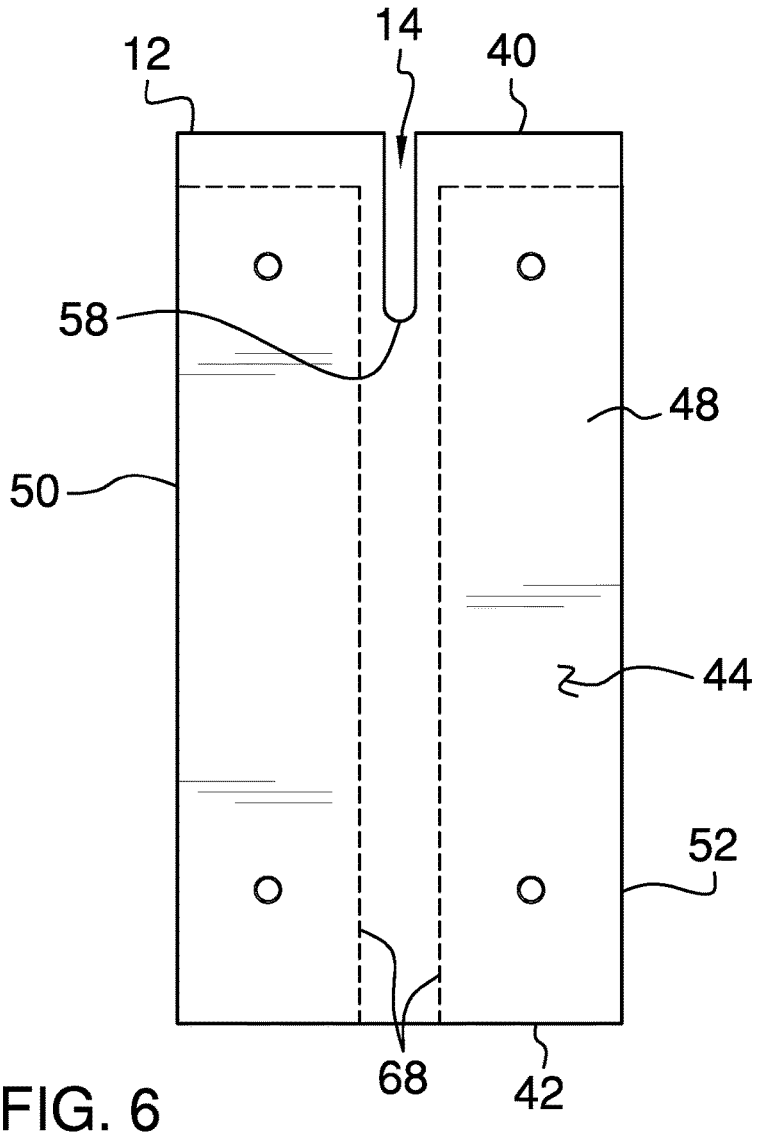
FIG. 6 is a bottom phantom view of an embodiment of the disclosure.
Figure 7:
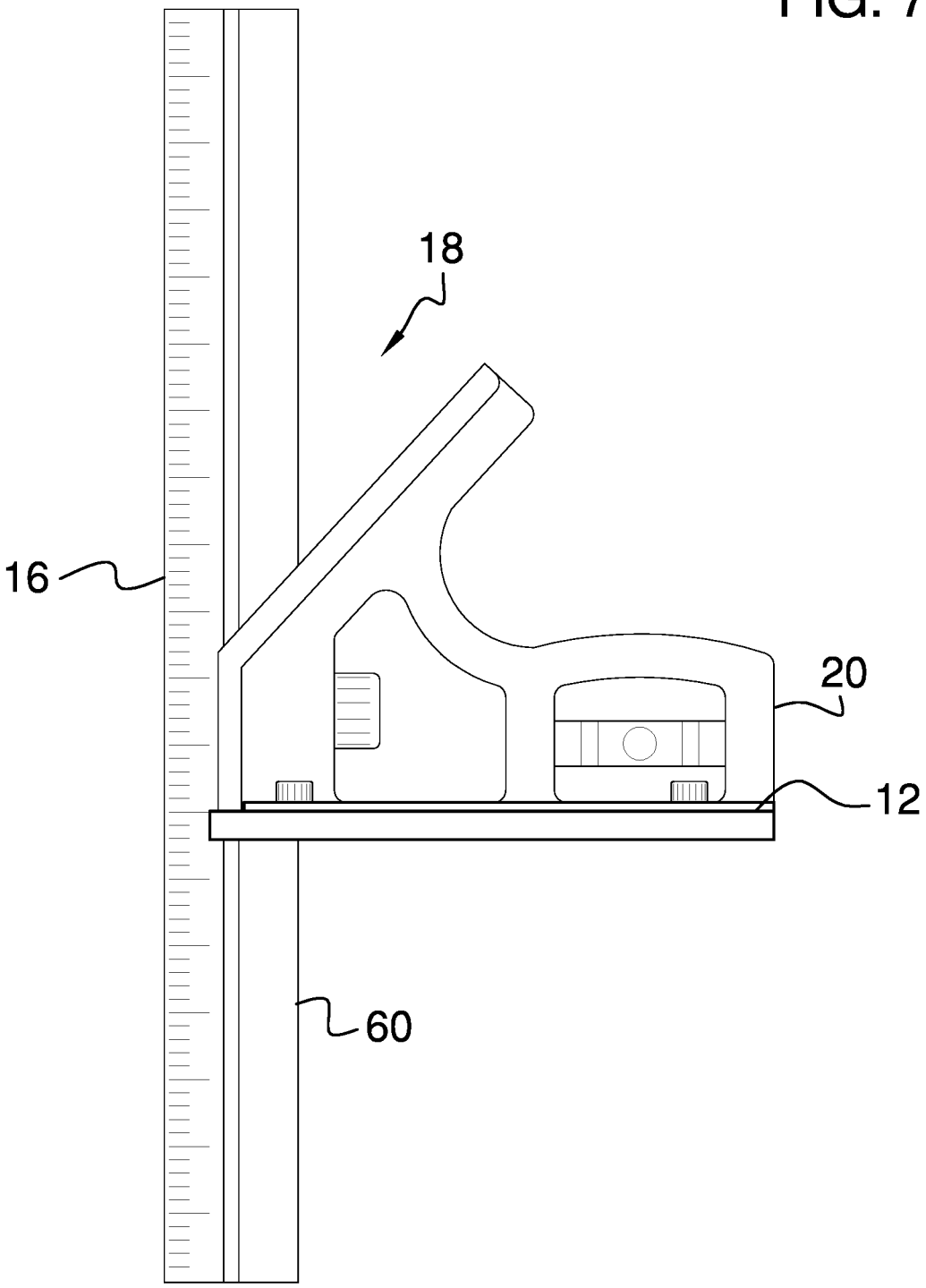
FIG. 7 is an in-use view of an embodiment of the disclosure.
Figure 8:
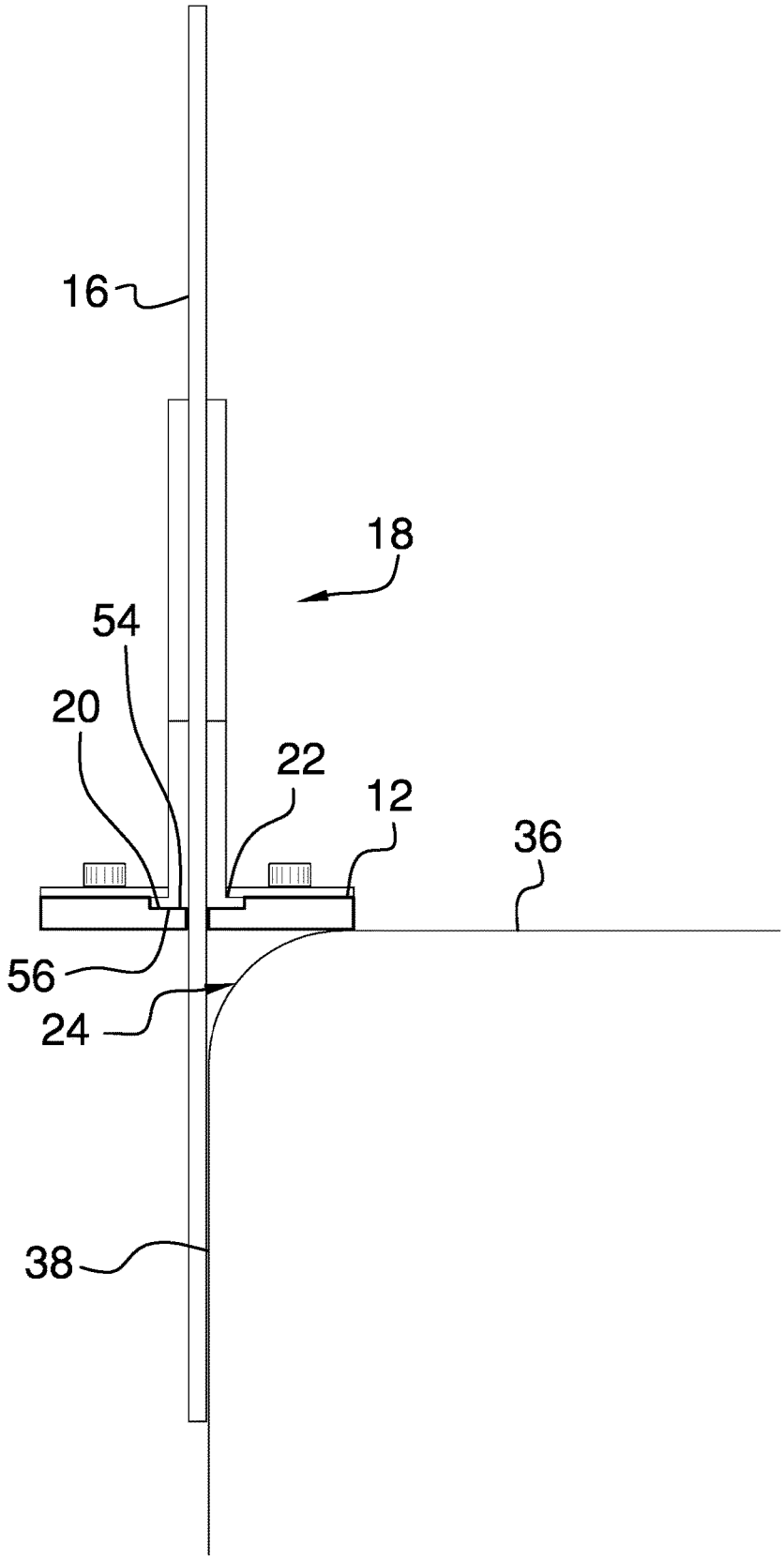
FIG. 8 is a perspective in-use view of an embodiment of the disclosure showing a combination square being positioned on a radiused corner.

With reference now to the drawings, and in particular to FIGS. 1 through 8 thereof, a new extension device embodying the principles and concepts of an embodiment of the disclosure and generally designated by the reference numeral 10 will be described.

As best illustrated in FIGS. 1 through 8, the base extension assembly 10 generally comprises a base 12 that has a blade slot 14 extending therein to insertably receive a blade 16 of a combination square 18. The base 12 has a channel 20 integrated therein to receive an anvil 22 of the combination square 18. The base 12 has a width that is greater than the width of the anvil 22. In this way the base 12 can extend beyond a radius of a radiused corner 24 being measured with the combination square 18 thereby enhancing accuracy of the combination square 18. Thus, the base 12 can be positioned flush against a first surface 36 that intersects with a second surface 38 associated with the radiused corner 24. Additionally, the blade 16 of the combination square 18 can be positioned flush against the second surface 38. In this way the combination square 18 can be accurately positioned in a perpendicular orientation on the radiused corner 24.

The channel 20 is oriented to extend along a common axis with respect to the blade slot 14. The base 12 has a first end 40, a second end 42 and an outer surface 44 extending therebetween. The outer surface 44 has a top side 46 and a bottom side 48, and the base 12 is elongated between the first end 40 and the second end 42. The blade slot 14 extends from the first end 40 toward the second end 42, and the blade slot 14 is centrally positioned on the first end 40.

The channel 20 extends from the top side 46 toward the bottom side 48, and the channel 20 extends between the first end 40 and the second end 42. The channel 20 is centrally positioned between a first lateral edge 50 and a second lateral edge 52 of the base 12. The blade slot 14 is centrally positioned in the channel 20 and the channel 20 has a lower bounding surface 54. A bottom surface 56 of the anvil 22 of the combination square 18 rests on the lower bounding surface 54 such that the anvil 22 of the combination square 18 extends along a full length of the channel 20.

The blade slot 14 has a terminal end 58 and a leading edge 60 of the blade 16 of the combination square 18 is abutted against the terminal end 58. The top side 46 has a pair of first wells 62 each extending toward the bottom side 48, and the first wells 62 are spaced apart from each other and are distributed along the first lateral edge 50 of the base 12. The top side 46 has a pair of second wells 64 each extending toward the bottom side 48. The second wells 64 are spaced apart from each other and are distributed along the second lateral edge 52 of the base 12. Each of the first wells 62 and the second wells 64 has a bounding surface 66, and the bounding surface 66 is threaded.

A pair of plates 68 is provided and each of the plates 68 is positionable on the base 12. Each of the plates 68 extend partially over the channel 20 when the plates 68 are positioned on the base 12 to retain the anvil 22 of the combination square 18 in the channel 20. Each of the plates 68 has a lower surface 70 and an upper surface 72, and the lower surface 70 of each of the plates 68 rests against the top side 46 of the outer surface 44 of the base 12 when the plates 68 are positioned on the base 12. Each of the plates 68 covers a respective one of the pair of first wells 62 or the pair of second wells 64 when the plates 68 are positioned on the base 12.

A plurality of fasteners 74 is each extendable through a respective one of the plates 68 to engage the base 12 for attaching the plates 68 to the base 12. Each of the fasteners 74 has an outside surface 76 and the outside surface 76 of each of the fasteners 74 is threaded. Moreover, the outside surface 76 of each of the fasteners 74 threadably engages the bounding surface 66 of a respective one of the first wells 62 and the second wells 64. Each of the fasteners 74 may comprise a screw or other type of multiple use, mechanical fastener.

In use, the anvil 22 of the combination square 18 is positioned in the channel 20 and the blade 16 is positioned in the blade slot 14 such that the blade 16 abuts the terminal end 58 of the blade slot 14. Each of the plates 68 is positioned in the base 12 such that each of the plates 68 extends partially over the anvil 22. Each of the fasteners 74 is extended through the respective plate 68 to attach the respective plate 68 to the base 12. In this way the base 12 is attached to the combination square 18. As is most clearly shown in FIG. 7, the base 12 is sufficiently wide to extend across the first surface 36 of the radiused corner 24 when the blade 16 is positioned flat against the second surface 38 of the radiused corner 24. In this way the combination square 18 can be accurately positioned in a perpendicular orientation of the radiused corner 24 for making various measurements.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A base extension assembly for expanding a base of a combination square thereby facilitating the combination square to squarely fit on a radiused corner, said assembly comprising:

a base having a blade slot extending therein wherein said blade slot is configured to insertably receive a blade of a combination square, said base having a channel being integrated therein wherein said channel is configured to receive an anvil of the combination square, said base having a width being greater than the width of the anvil wherein said base is configured to extend beyond a radius of a corner being measured with the combination square thereby enhancing accuracy of the combination square, said channel being oriented to extend along a common axis with respect to said blade slot, said base having a first end, a second end and an outer surface extending therebetween, said outer surface having a top side and a bottom side, said base being elongated between said first end and said second end, said blade slot extending from said first end toward said second end, said channel extending from said top side toward said bottom side, said channel extending between said first end and said second end;

a pair of plates, each of said plates being positionable on said base, each of said plates extending partially over said channel when said plates are positioned on said base wherein each of said plates is configured to retain the anvil of the combination square in said channel, each of said plates being spaced from said first end of said base toward said second end, each of said plates having a closest edge to said first end of said base, said closest edge extending along a full width of an associated one of said plates; and a plurality of fasteners, each of said fasteners being extendable through a respective one of said plates and engaging said base for attaching said plates to said base.

2. The assembly according to claim 1, wherein said blade slot is centrally positioned on said first end.

3. The assembly according to claim 2, wherein said channel is centrally positioned between a first lateral edge and a second lateral edge of said base, said blade slot being centrally positioned in said channel, said channel having a lower bounding surface wherein said lower bounding surface is configured to have a bottom surface of the anvil of the combination square resting thereon such that the anvil of the combination square extends along a full length of said channel, said blade slot having a terminal end wherein said terminal end is configured to have a leading edge of the blade of the combination square abutted thereagainst.

4. The assembly according to claim 2, wherein said top side has a pair of first wells each extending toward said bottom side, said first wells being spaced apart from each other and being distributed along a first lateral edge of said base, said top side having a pair of second wells each extending toward said bottom side, said second wells being spaced apart from each other and being distributed along a second lateral edge of said base, each of said first wells and said second wells having a bounding surface, said bounding surface being threaded.

5. The assembly according to claim 1, wherein:

said base has an outer surface, said outer surface having a top side, said top side having a pair of first wells and a pair of second wells extending downwardly therein; and each of said plates has a lower surface and an upper surface, said lower surface of each of said plates resting against said top side of said outer surface of said base when said plates are positioned on said base, each of said plates covering a respective one of said pair of first wells or said pair of second wells when said plates are positioned on said base.

6. A base extension assembly for expanding a base of a combination square thereby facilitating the combination square to squarely fit on a radiused corner, said assembly comprising:

a base having a blade slot extending therein wherein said blade slot is configured to insertably receive a blade of a combination square, said base having a channel being integrated therein wherein said channel is configured to receive an anvil of the combination square, said base having a width being greater than the width of the anvil wherein said base is configured to extend beyond a radius of a corner being measured with the combination square thereby enhancing accuracy of the combination square, said channel being oriented to extend along a common axis with respect to said blade slot, said base having a first end, a second end and an outer surface extending therebetween, said outer surface having a top side and a bottom side, said base being elongated between said first end and said second end, said blade slot extending from said first end toward said second end, said blade slot being centrally positioned on said first end, said channel extending from said top side toward said bottom side, said channel extending between said first end and said second end, said channel being centrally positioned between a first lateral edge and a second lateral edge of said base, said blade slot being centrally positioned in said channel, said channel having a lower bounding surface wherein said lower bounding surface is configured to have a bottom surface of the anvil of the combination square resting thereon such that the anvil of the combination square extends along a full length of said channel, said blade slot having a terminal end wherein said terminal end is configured to have a leading edge of the blade of the combination square abutted thereagainst, said top side having a pair of first wells each extending toward said bottom side, said first wells being spaced apart from each other and being distributed along said first lateral edge of said base, said top side having a pair of second wells each extending toward said bottom side, said second wells being spaced apart from each other and being distributed along said second lateral edge of said base, each of said first wells and said second wells having a bounding surface, said bounding surface being threaded;

a pair of plates, each of said plates being positionable on said base, each of said plates extending partially over said channel when said plates are positioned on said base wherein each of said plates is configured to retain the anvil of the combination square in said channel, each of said plates being spaced from said first end of said base toward said second end, each of said plates having a closest edge to said first end of said base, said closest edge extending along a full width of an associated one of said plates, each of said plates having a lower surface and an upper surface, said lower surface of each of said plates resting against said top side of said outer surface of said base when said plates are positioned on said base, each of said plates covering a respective one of said pair of first wells or said pair of second wells when said plates are positioned on said base; and a plurality of fasteners, each of said fasteners being extendable through a respective one of said plates and engaging said base for attaching said plates to said base, each of said fasteners having an outside surface, said outside surface of each of said fasteners being threaded, said outside surface of each of said fasteners threadably engaging said bounding surface of a respective one of said first wells and said second wells.

7. A base extension system for expanding a base of a combination square thereby facilitating the combination square to squarely fit on a radiused corner, said system comprising:

a combination square having an anvil and a blade;

a base having a blade slot extending therein to insertably receive said blade of said combination square, said base having a channel being integrated therein to receive said anvil of said combination square, said base having a width being greater than the width of the anvil wherein said base is configured to extend beyond a radius of a corner being measured with said combination square thereby enhancing accuracy of said combination square, said channel being oriented to extend along a common axis with respect to said blade slot, said base having a first end, a second end and an outer surface extending therebetween, said outer surface having a top side and a bottom side, said base being elongated between said first end and said second end, said blade slot extending from said first end toward said second end, said blade slot being centrally positioned on said first end, said channel extending from said top side toward said bottom side, said channel extending between said first end and said second end, said channel being centrally positioned between a first lateral edge and a second lateral edge of said base, said blade slot being centrally positioned in said channel, said channel having a lower bounding surface, said lower bounding surface having a bottom surface of said anvil of said combination square resting thereon such that said anvil of said combination square extends along a full length of said channel, said blade slot having a terminal end having a leading edge of said blade of said combination square abutted thereagainst, said top side having a pair of first wells each extending toward said bottom side, said first wells being spaced apart from each other and being distributed along said first lateral edge of said base, said top side having a pair of second wells each extending toward said bottom side, said second wells being spaced apart from each other and being distributed along said second lateral edge of said base, each of said first wells and said second wells having a bounding surface, said bounding surface being threaded;

a pair of plates, each of said plates being positionable on said base, each of said plates extending partially over said channel when said plates are positioned on said base to retain said anvil of said combination square in said channel, each of said plates being spaced from said first end of said base toward said second end, each of said plates having a closest edge to said first end of said base, said closest edge extending along a full width of an associated one of said plates, each of said plates having a lower surface and an upper surface, said lower surface of each of said plates resting against said top side of said outer surface of said base when said plates are positioned on said base, each of said plates covering a respective one of said pair of first wells or said pair of second wells when said plates are positioned on said base; and a plurality of fasteners, each of said fasteners being extendable through a respective one of said plates and engaging said base for attaching said plates to said base, each of said fasteners having an outside surface, said outside surface of each of said fasteners being threaded, said outside surface of each of said fasteners threadably engaging said bounding surface of a respective one of said first wells and said second wells.

* * * * *